US006766675B2

(12) United States Patent
Suzuki et al.

(10) Patent No.: US 6,766,675 B2
(45) Date of Patent: Jul. 27, 2004

(54) SPINDLE MECHANISM

(75) Inventors: Yukinori Suzuki, Aichi (JP); Kiyofumi Sakuragawa, Aichi (JP)

(73) Assignee: Sango Co., Ltd., Aichi (JP)

( * ) Notice: Subject to any disclaimer, the term of this patent is extended or adjusted under 35 U.S.C. 154(b) by 0 days.

(21) Appl. No.: 10/311,294

(22) PCT Filed: Apr. 17, 2002

(86) PCT No.: PCT/JP02/03837

§ 371 (c)(1),
(2), (4) Date: Dec. 17, 2002

(87) PCT Pub. No.: WO02/085551

PCT Pub. Date: Oct. 31, 2002

(65) Prior Publication Data

US 2003/0140674 A1 Jul. 31, 2003

(30) Foreign Application Priority Data

Apr. 18, 2001 (JP) ..... 2001-119054

(51) Int. Cl.[7] ..... B21D 3/02
(52) U.S. Cl. ..... 72/121; 72/122; 72/452.8
(58) Field of Search ..... 72/120, 121, 122, 72/452.1, 452.8, 452.9; 464/1, 162; 403/355, 356

(56) References Cited

U.S. PATENT DOCUMENTS 4,061,009 A * 12/1977 Kaporovich et al. ..... 72/69
5,788,733 A * 8/1998 Dieckow ..... 65/292
6,295,856 B1 * 10/2001 Tobimatsu et al. ..... 72/121
6,368,052 B2 * 4/2002 Uesugi et al. ..... 415/80

FOREIGN PATENT DOCUMENTS

| | | | |
|---|---|---|---|
| EP | 1052035 | 11/2000 | |
| EP | 1151812 | 11/2001 | |
| JP | 1-198334 | * 8/1989 | ..... 72/120 |
| JP | 01258833 | 10/1989 | |
| JP | 01258834 | 10/1989 | |
| JP | 38412 | 2/1991 | |
| JP | 2957153 | 7/1999 | |
| JP | 2957154 | 7/1999 | |
| JP | 2001030018 | 2/2001 | |

OTHER PUBLICATIONS

International Search Report dated Jul. 30, 2002.

* cited by examiner

*Primary Examiner*—Ed Tolan
(74) *Attorney, Agent, or Firm*—Stevens, Davis, Miller & Mosher, LLP.

(57) ABSTRACT

In order to achieve the lightweight, low-cost and high-efficiency design of a spindle apparatus, speed-change device 50 is provided such that slots 31 are formed in one of a spindle 10 and a cam shaft 12 while spiral torque cam grooves are formed in another, and extend around the axis thereof. A torque cam pin 34 is engaged in each slot and its associated torque cam groove, and the position of the spindle 10 relative to the cam shaft 12 in a circumferential direction can be changed by moving the torque cam pins 34 in the axial direction by drive device 43. Drawing tools 8 are moved in opening and closing directions by changing the position of the spindle 10 relative to the cam shaft 12 in the circumferential direction.

8 Claims, 11 Drawing Sheets

SPINDLE MECHANISM

TECHNICAL FIELD

This invention relates to a spindle mechanism, and more particularly to a spindle mechanism in a drawing apparatus, in which drawing tools, while revolved, are slid in a radial direction.

BACKGROUND ART

As shown in FIG. 14A, there is known a conventional method in which drawing tools (spinning rollers) 102 are moved in a direction X—X (axial direction) and a direction Y—Y (radial direction) at an end portion of a tube 101 of metal, the end portion of the tube 101 is drawn by spinning, and a gradually-tapered portion 103 and a smaller-diameter portion 104 are formed integrally at the end portion of an ordinary portion (stock tube portion) 101*a* of the tube in coaxial relation thereto. As shown in FIG. 14B, there is known another method in which a gradually-tapered portion 103 and a smaller-diameter portion 104 are formed in an eccentric (offset) relation to an axis of an ordinary portion (stock tube portion) of a tube 101. Although not shown in the drawings, there is known a further method in which the gradually-tapered portion 103 and the smaller-diameter portion 104 are formed in an oblique and skew relation to the axis of the tube 101. Methods of forming such tubes are disclosed, for example, in JP-B2-2957153 and JP-B2-2957154.

Among the above spinning methods, for example, JP-B2-3-008412 discloses a spindle mechanism of a special-purpose apparatus for effecting a spinning operation, in which a workpiece (stock tube) is fixed, and the spinning is carried out by revolving spinning rollers. In the spindle mechanism proposed and disclosed in this publication, a spindle and an auxiliary shaft (cam shaft) are provided coaxially with each other, and a slide base is mounted on one of the two while a cam plate is mounted on the other, and the difference in rotational speed is produced between the slide base and the cam plate by the rotational speed difference between the spindle and the auxiliary shaft, and drawing tools (spinning rollers), mounted on the slide base, are arbitrarily moved in a radial direction by this rotational speed difference.

In the above conventional spindle mechanism, planetary gear mechanisms (planetary units) are provided respectively at the spindle and the auxiliary shaft in order to produce the rotational speed difference between the spindle and the auxiliary shaft, and these are worked with each other to form a speed-change system. The speed-change system is thus formed by working the two planetary gear mechanisms with each other, and therefore this system is complicated, and the weight and cost increase, and besides, a backlash and a rotational inertia loss are large, and therefore the efficiency is not good.

Furthermore, the heavy speed-change system is supported by the spindle and the auxiliary shaft, and thus the two shafts need to have a large strength, and there are encountered problems that it is difficult to achieve a lightweight design of the two shafts and that it is difficult to pass a mandrel or the like through the spindle.

In order to solve these problems, for example, EP1052035A1 discloses a drawing system in which a speed-change mechanism is provided separately from a spindle mechanism comprising such a spindle and a cam shaft (auxiliary shaft) as described above. However, since the independent speed-change mechanism is provided, there is encountered a problem that the compact, lightweight and low-cost design of the spindle mechanism can not be achieved satisfactorily.

It is therefore an object of this invention to provide a spindle mechanism which solve the above problems.

DISCLOSURE OF THE INVENTION

In order to solve the above problems, the present invention provides a spindle mechanism wherein a drawing tool-mounting member, on which drawing tools are supported for sliding movement in a radial direction, is provided at a distal end of a spindle, and a cam shaft is rotatably provided at the spindle in coaxial relation thereto, and a cam plate whose rotation causes the drawing tools to move in the radial direction is provided at a distal end of the cam shaft, and a relative rotation difference is produced between the spindle and the cam shaft, thereby moving the drawing tools in the radial direction;

characterized in that the relative rotation difference between the spindle and the cam shaft is produced by adjusting a condition of engagement of the spindle with the cam shaft.

With this construction, in a condition in which the spindle and the cam shaft rotate in the same direction, when the condition of engagement of the spindle with the cam shaft in the circumferential direction is adjusted, the relative rotation difference between the spindle and the cam shaft is produced, so that the drawing tools are moved in the radial direction.

In the present invention, the structure may be constructed that a slot is formed in one of the spindle and the cam shaft while a spiral torque cam groove is formed in the other to extend around an axis thereof, and a torque cam pin is engaged in the slot and the torque cam groove, and the torque cam pin is moved in the axial direction by drive means so as to change the relative position of the spindle with respect to the cam shaft in a circumferential direction.

In this construction, the longitudinal directions of the slot and the torque cam groove are inclined relative to each other, and therefore, when the torque cam pin engaged in the slot and the torque cam groove is moved in the axial direction, the position of the spindle relative to the cam shaft in the circumferential direction is changed, and the relative rotation difference is produced between the spindle and the cam shaft, so that the drawing tools are moved in the radial direction.

In the present invention, the structure also may be so constructed that the cam shaft is mounted within the spindle in coaxial relation thereto, and the slot is formed in the spindle, and the torque cam groove is formed in the cam shaft.

In this construction, also, similar effects as described above are achieved.

In the present invention, further, the structure may be constructed that a holder is mounted on an outer periphery of the spindle for rotation and for sliding movement in the axial direction, and the torque cam pin is provided at the holder, and the holder can be moved in the axial direction by drive means.

In this structure, the holder provided with the torque cam pin is mounted on the outer periphery of the spindle, and when the torque cam pin is moved with the holder in the direction of the axis of the spindle, the holder is satisfactorily moved in the axial direction since the slot is formed in the spindle.

In the present invention, the structure can be also constructed that the spindle and the cam shaft are made of a hollow tube, respectively, and the latter is fitted into the former so as to rotate relatively to each other, and a mandrel is provided in the hollow tube of a smaller diameter so as to move forward and backward.

In this construction, the mandrel can be arranged so as to move in the axial direction in a center portion of the spindle and cam shaft.

MODE FOR CARRYING OUT THE INVENTION

The present invention will now be described in further detail with reference to FIGS. 1 to 13 showing embodiments of the invention.

FIGS. 1 to 9 show the first embodiment according to the invention.

Figure 1:
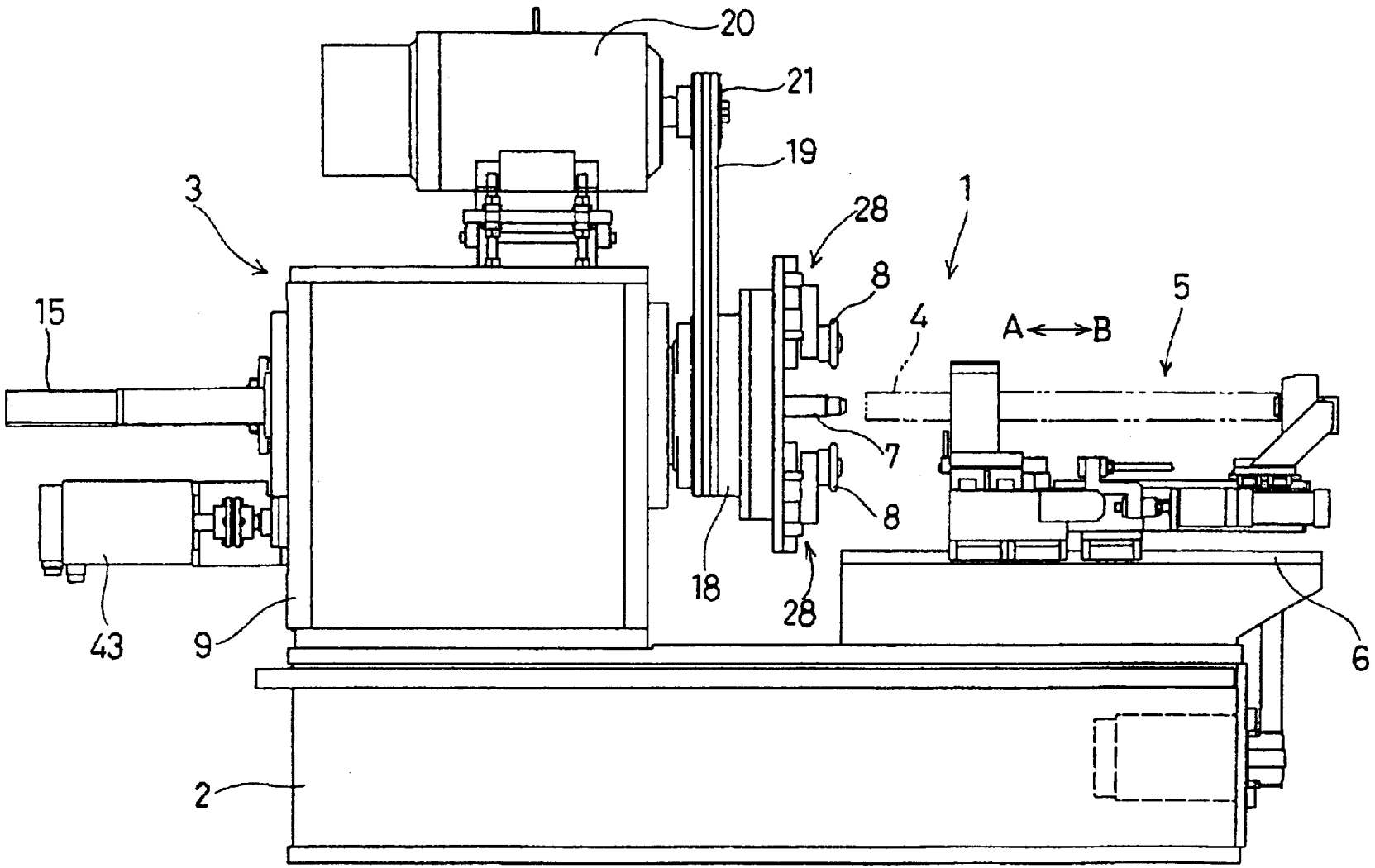
FIG. 1 is a side-elevational view of a first embodiment of a drawing apparatus provided with a spindle apparatus according to the present invention.

In FIG. 1, a drawing apparatus 1 comprises a spindle mechanism 3 on a bed 2, and a support mechanism 5 for supporting a workpiece, such for example as a metal tube 4, in an opposed relation to the spindle mechanism 3. The spindle mechanism 3 is fixedly mounted on the bed 2, and the support mechanism 5 is movable in a direction of an arrow A-B along a guide rail 6.

The support mechanism 5 is moved in the direction of the arrow A, and a distal end portion of the supported metal tube 4 is fitted on a mandrel 7 provided at the spindle mechanism 3, and drawing tools 8, while being revolved around the axis of the mandrel 7, are moved radially (in radial and centripetal directions) of the metal tube 4, and at the same time the metal tube 4 is moved in an axial direction, thereby forming a reduced-diameter portion of a desired shape at the end portion of the metal tube 4. In the illustrated example, spinning rollers are used as the drawings tools 8.

Next, the spindle mechanism 3 will be described in detail with reference to FIGS. 2 to 9.

A box member 9 is fixedly mounted on the bed 2, and a spindle 10 is rotatably supported horizontally in the box member 10 through bearings 11. The spindle 10 is formed of a cylindrical hollow tube, and a cam shaft 12 is received in the spindle 10, and is rotatably supported by bearings 13. The spindle 10 and the cam shaft 12 can rotate relative to each other in the circumferential direction in coaxial relation to each other. The cam shaft 12 is formed of a cylindrical hollow tube, and the mandrel 7 is received in the cam shaft 12, and is held in a non-rotating condition such that the mandrel 7 will not rotate, following the rotation of the cam shaft 12. More specifically, the mandrel 7 is held by drive means, such for example as an advancing/retracting cylinder 15, mounted on an arm 14 fixedly secured to the box member 9, via a connecting rod 16, and when the advancing/retracting cylinder 15 is driven for advancing and retracting purposes, the mandrel 7 is moved forward and backward in the direction of the arrow A-B within the cam shaft 12 without being rotated.

Figure 4:
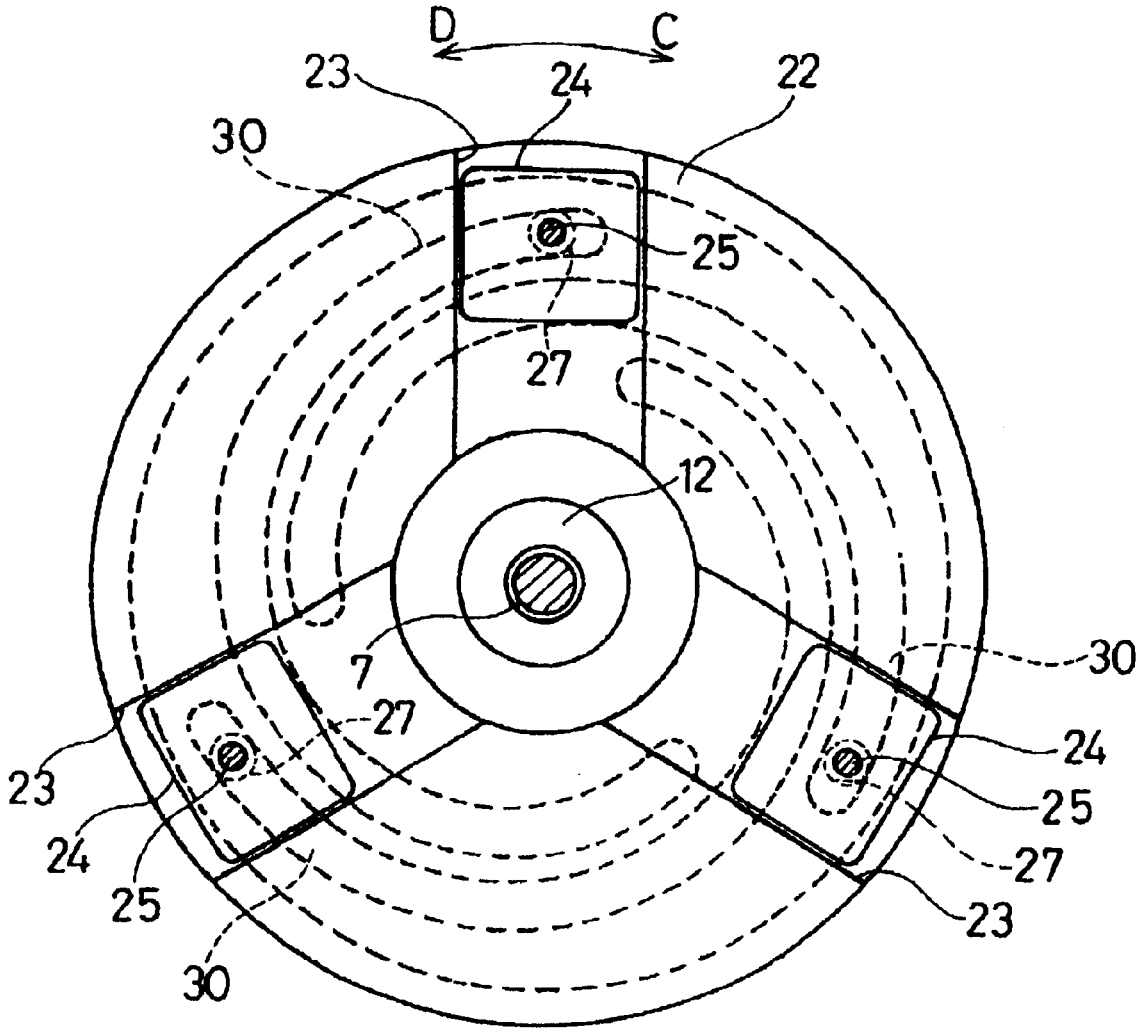
FIG. 4 is an enlarged cross-sectional view taken along the line IV—IV of FIG. 2.
Figure 5:
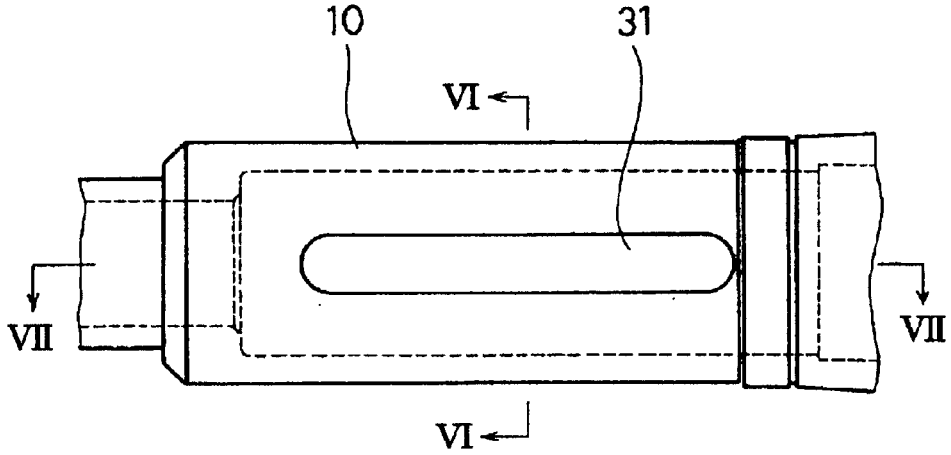
FIG. 5 is a plan view of the spindle in FIG. 2.

A member 17 is fixedly secured to a front end of the spindle 10, and a mounting flange 18 is fixedly secured to this member 17, and belts 19 are extended around the mounting flange 18. The belts 19 are extended around a drive pulley 21 of a drive motor 20 serving as drive means, and when the drive motor 20 is rotated, the mounting flange 18 and the spindle 10 are rotated together through the drive pulley 21 and the belts 19. Further, a drawing tool-mounting member 22 is fixedly secured to a distal end of the mounting flange 18. Guide grooves 23 are formed in a front surface of the drawing tool-mounting member 22, and extend radially, that is, in a radial direction of the axis of the spindle 10 and cam shaft 12. The plurality of guide grooves 23 are formed at equal intervals on the circumference of the drawing tool-mounting member 22, and in the illustrated example, the three guide grooves are formed as shown in FIG. 4. Further, a moving member 24 is fitted in each of the guide grooves 23 so as to slide along the guide groove 23, that is, in the radial and centripetal directions.

A shaft 25 is fixedly mounted horizontally on the moving member 24, and a tool support arm 26 is fixedly mounted on a front end of the shaft 25, and further the drawing tool 8 is mounted on a front end of the tool support arm 26. A roller 27 is provided at a rear end of the shaft 25. The moving member 24, the shaft 25, the tool support arm 26 and the roller 27 constitute a drawing tool-supporting member 28.

A cam plate 29 is fixedly secured to a front end of the cam shaft 12 so that the cam plate 29 can rotate together with the cam shaft 12. The cam plate 29 is disposed at the reverse side of the drawing tool-mounting member 22 so as to rotate relative to this member 22, and volute-like grooves 30 are formed in a front surface of this cam plate, and are disposed around the axis of the cam shaft 12, as shown in FIG. 4. Each of the rollers 27 is slidably fitted in one of the volute-like grooves 30, respectively. When the position of the drawing tool-mounting member 22 relative to the cam shaft 29 in the circumferential direction is changed, the rollers 27 are guided respectively by the volute-like grooves 30 to be moved in the radial or centripetal direction.

Figure 2:
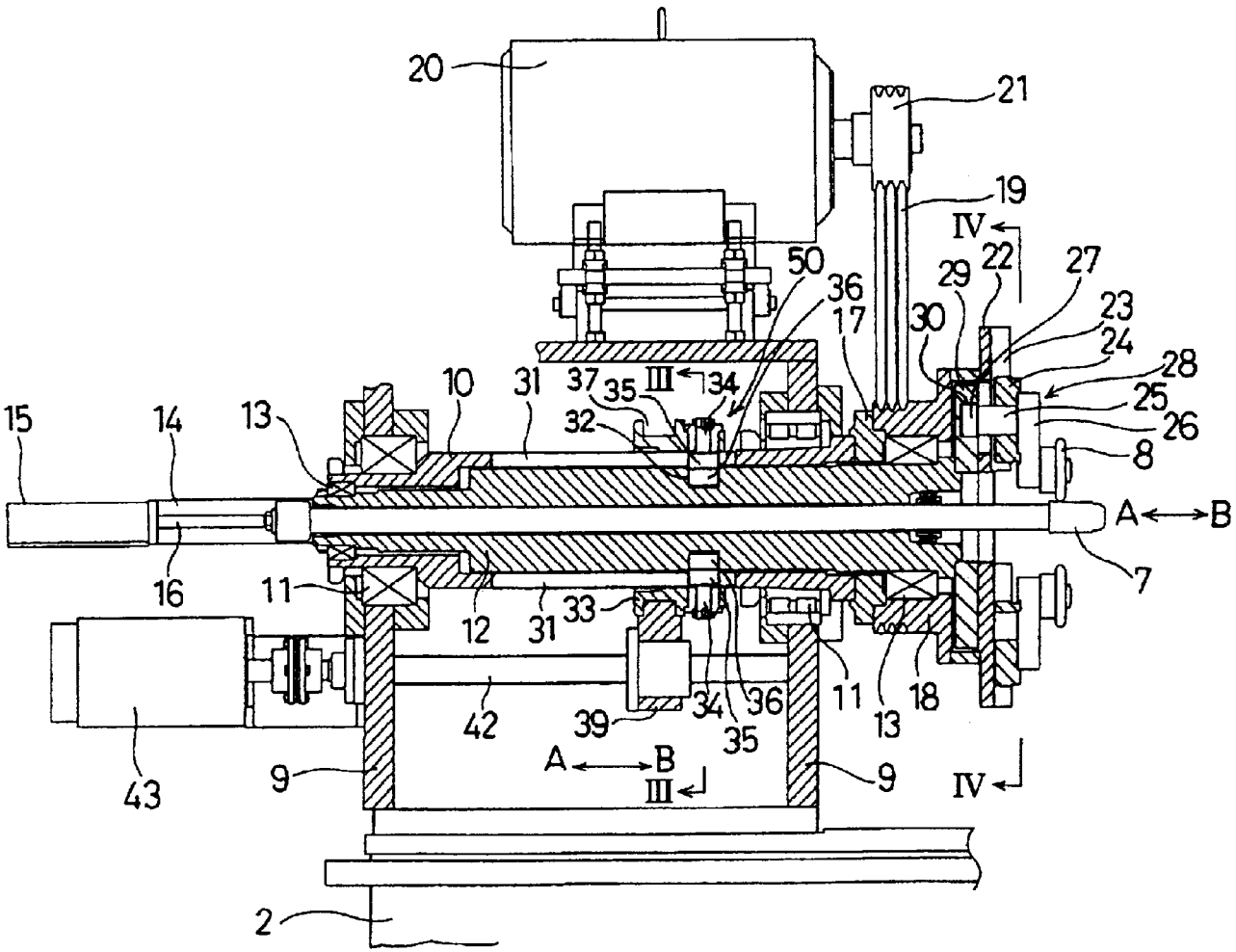
FIG. 2 is a side cross-sectional view showing the first embodiment of the spindle apparatus according to the invention.
Figure 6:
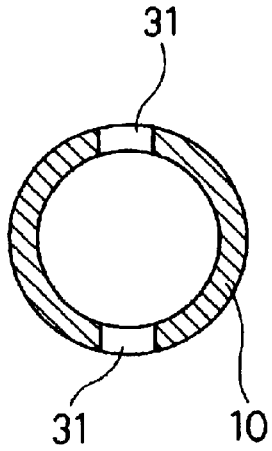
FIG. 6 is a cross-sectional view taken along the line VI—VI of FIG. 5.
Figure 7:
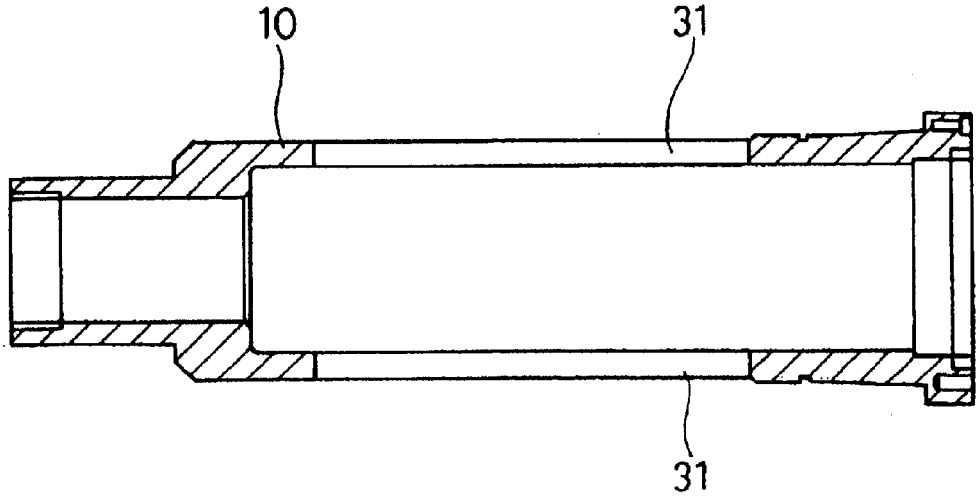
FIG. 7 is a cross-sectional view taken along the line VII—VII of FIG. 5.

As shown in FIGS. 2 and 5 to 7, slots 31 are formed in the spindle 10, and extend along the axis of the spindle 10, and the slots 31 are perforated through the spindle 10 from its outer surface to its inner surface. The two slots 31 are arranged symmetrically with respect to the axis of the spindle 10 as shown in FIGS. 2 and 6.

Spiral torque cam grooves 32 are formed in the cam shaft 12, and extend spirally around the axis of the cam shaft 12, thus providing a so-called cylindrical cam. In the illustrated embodiment, although each torque cam groove 32 is in the form of a non-through groove with a closed bottom, which is open to the outer peripheral surface of the cam shaft 12, it may be a through groove formed through the cam shaft 12 from its outer surface to its inner surface. There are provided the two torque cam grooves 32 which extend over about one fourth of the outer periphery of the cam shaft 12 in the circumferential direction, and the two torque cam grooves are formed symmetrically with respect to the axis of the cam shaft 12. Further, the two torque cam grooves 32 are formed generally over the same area as that of the slots 31 in the axial direction.

The slots 31 and the torque grooves 32 are formed as described above, and thus, each slot 31 necessarily intersects the corresponding torque cam groove 32 at one point.

An annular holder 33 is rotatably fitted on the outer periphery of the spindle 10 in coaxial relation thereto, and is slidable in the direction of the axis of the spindle 10. Two torque cam pins 34 are provided at one side of the holder 33, and are arranged symmetrically with respect to the axis of the spindle 10, that is, at an interval of 180 degrees. The two torque cam pins 34 are disposed radially of the spindle 10, and a first roller 35 and a second roller 36 are rotatably supported at a distal end portion of each torque cam pin. The first roller 35 is received in the slot 31, and is held in contact with a side wall of the slot 33, and the second roller 36 is received in the torque cam groove 32, and is held in contact with a side wall of the torque cam groove 32.

Namely, each slot 31 intersects the corresponding torque cam groove 32 at one point, and the torque cam pin 34, that is, the first roller 35, is located at that portion of the slot 31 disposed at this intersection point, and the torque cam pin 34, that is, the second roller 36, is located at that portion of the torque cam groove 32 disposed at this intersection point. Therefore, when each torque cam pin 34 is linearly moved, together with the first roller 35, along the slot 31, the second roller 36 is also moved in the same direction, so that the cam shaft 12 is rotated in the circumferential direction since the torque cam groove 32, in which this second roller 36 is fitted, is formed into the spiral shape. Namely, the position of the spindle 10 relative to the cam shaft 12 is changed in the circumferential direction. The slots 31, the torque cam grooves 32 and the torque cam pins 34 form speed-change means 50.

An annular groove 37 is formed in an outer peripheral surface of the holder 33 over the entire circumference thereof.

Figure 3:
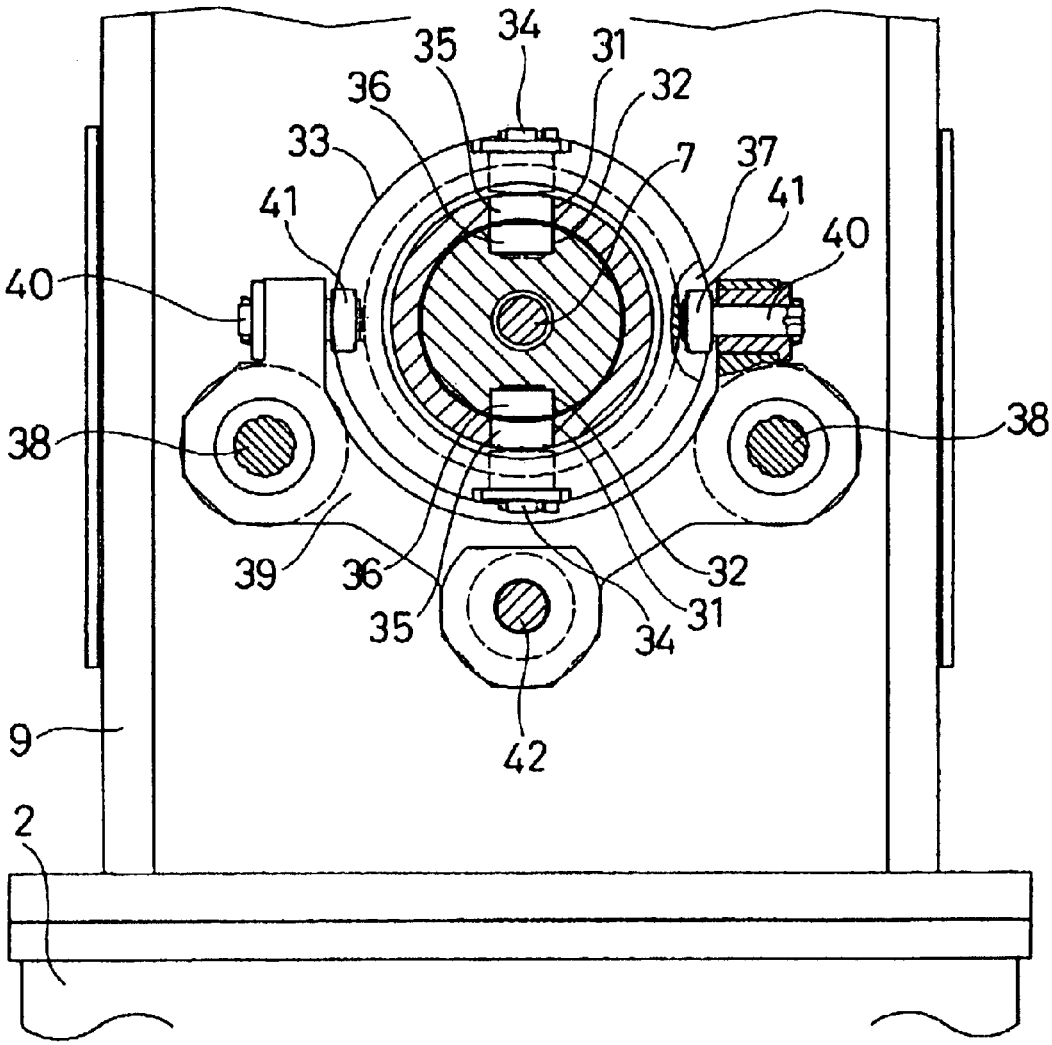
FIG. 3 is an enlarged cross-sectional view taken along the line III—III of FIG. 2.

As shown in FIG. 3, two guide rails 38 are fixedly mounted on the box member 9, and extend in a parallel relation to the axis of the spindle 10 and so on, and one bracket 39 is supported and fitted on the two guide rails 38 so as to slide in the direction of the axes of the guide rails 38. Therefore, the bracket 39, while being guided by the guide rails 38, can move in the direction A-B of FIG. 2, but will not rotate in the direction of the circumference of the spindle 10 and so on.

As shown in FIG. 3, a pair of (two) pins 40 are provided on the bracket 39, and are spaced 180 degrees from each other, and each of rollers 41 is rotatably mounted on one of the pins 40, respectively, and these rollers 41 are fitted in the annular groove 37 in the holder 33.

One drive threaded member (ball spline shaft) 42 extends through and in a screw engagement with the bracket 39, and this drive threaded member 42 is disposed parallel to the axis of the spindle 10, and is rotatably supported by the box member 9. The drive threaded member 42 can be rotated in normal and reverse directions by a opening/closing drive motor 43 shown in FIG. 2, and when the opening/closing drive motor 43 is rotated in an arbitrary amount in the normal or the reverse direction, the drive threaded member 42 is rotated in an amount corresponding to the rotated amount of the drive motor in the normal or the reverse direction, so that the bracket 39 is moved in an amount corresponding to the rotated amount of the member 42 in the direction of an arrow A or the direction of an arrow B.

Next, the drawing of the metal tube will be described.

First, the metal tube 4, which is the workpiece, is supported by the support mechanism 5 as shown in FIG. 1, and then the support mechanism 5 is advanced in a left direction of FIG. 1 so as to locate a portion to be drawn of the metal tube 4 (the distal end portion of the metal tube 4) at a position of the drawing tool 8 of the spindle mechanism 3, and the mandrel 7 of the spindle mechanism 3 is advanced by the advancing/retracting cylinder 15, and is inserted into the metal tube 4.

The drive motor 20 is driven to rotate the mounting flange 18 in one direction. In accordance with the rotation of the mounting flange 18, the spindle 10 rotates together with this mounting flange, and the torque cam pins 34, fitted respectively in the slots 31 in the spindle 10, rotate in the same direction. At this time, if the bracket 39, in the thread engagement with the drive threaded member 42, is held in an immovable condition, the holder 33 rotates at a predetermined portion of the spindle 10 in the axial direction, and the torque cam pins 34 revolve around the axis of the spindle 10 at the predetermined position in the axial direction. In accordance with the revolution of the torque cam pins 34, the second roller 36, mounted on each torque cam pin 34, revolves together with the torque cam pin 34, and is retainingly engaged with the side surface of the torque cam groove 32 in the cam shaft 12, so that the cam shaft 12 is rotated in the same direction by this torque. Therefore, the spindle 10 and the cam shaft 12 rotate in the same direction, and at the same time the drawing tool-mounting member 22, fixedly secured to the mounting flange 18, also rotates in the same direction, so that the drawing tools 8 revolve around the axis of the spindle 10 through their respective tool support arms 26.

Figure 8B:
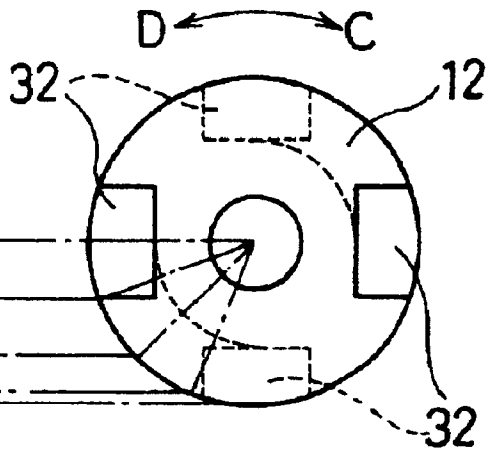
FIG. 8B is a cross-sectional view taken along the line VIIIB—VIIIB of FIG. 8A, and in this Figure, hatching, indicating the cross-section, is omitted.
Figure 8A:
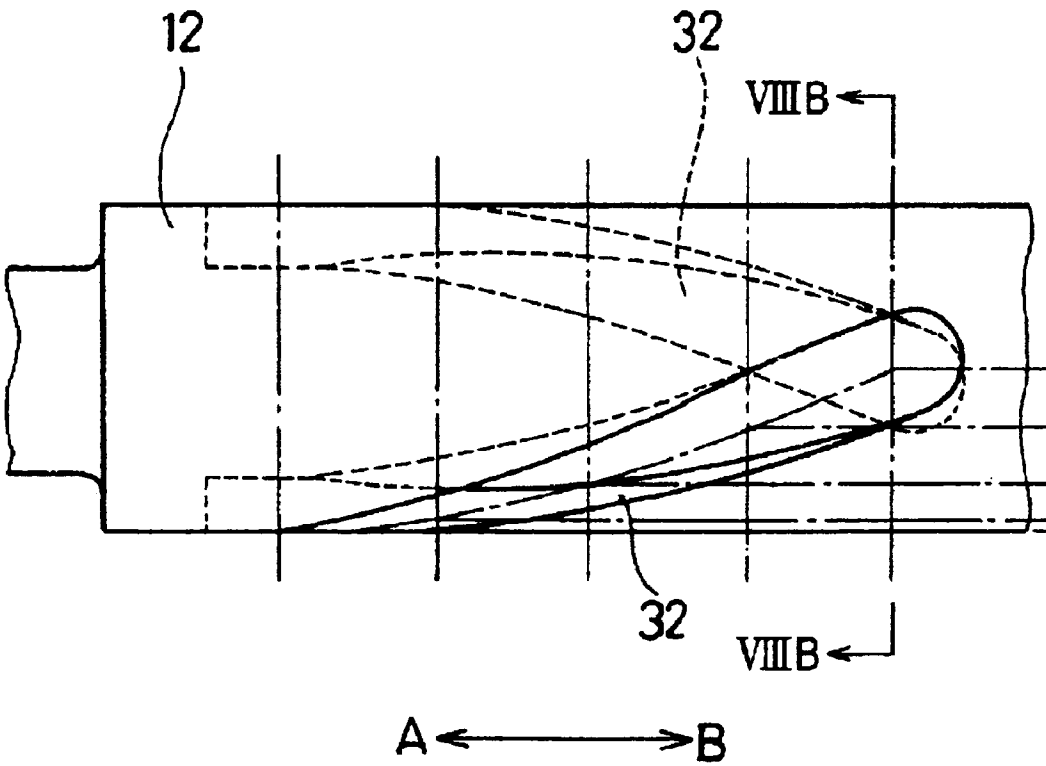
FIG. 8A is a plan view showing a profile of torque cam grooves in the cam shaft of FIG. 2.
Figure 9:
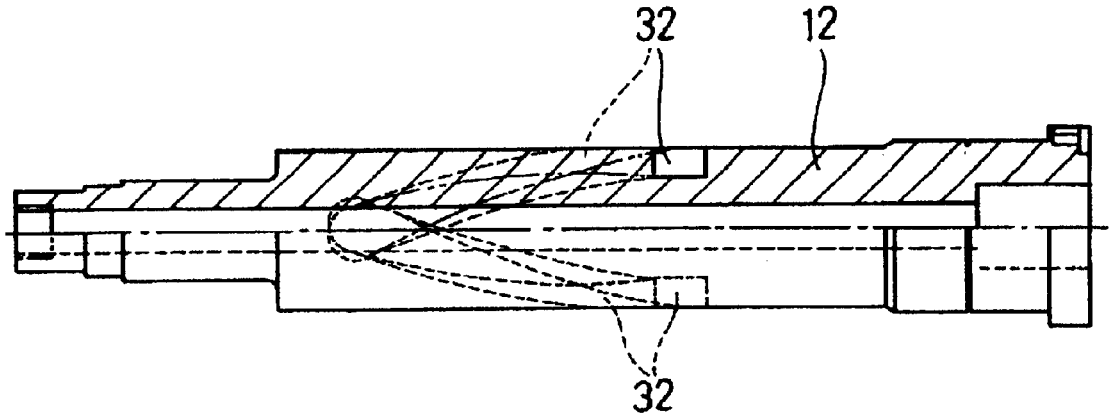
FIG. 9 is a side-elevational view of the cam shaft of FIG. 2, with an upper half thereof being cut.

In the above rotating condition, when the drive threaded member 42 is rotated in one direction by the opening/closing drive motor 43 to move the bracket 39 in the direction A in FIGS. 2, 8A and 8B, the holder 33 is also moved in the same direction A, so that the torque cam pins 34 are also moved in the same direction A. In accordance with this movement of the torque cam pins 34, the first roller 35 and second roller 36 of each torque cam pin, while guided by the slot 31 formed in the spindle 10, move along the axis of the spindle 10 in the direction A. At this time, the second roller 36 engages the side surface of the torque cam groove 32 to rotate the cam shaft 12 in a direction C of FIG. 8B relative to the spindle 10 since the torque cam groove 32, in which the second roller 36 is fitted, is formed into the spiral configuration as shown in FIG. 8A. In accordance with this rotation of the cam shaft 12, the cam plate 29 also rotates in the direction C relative to the drawing tool-mounting member 22 fixedly mounted on the spindle 10. The direction of rotation of the cam plate 29 at this time is the direction C in FIG. 4, and in the case where the volute-like grooves 30 in the cam plate 29 are formed as shown in FIG. 4, the shaft 25 of each drawing tool-supporting member 28 moves in a diameter-decreasing direction (centripetal direction) relative to the volute-like groove 30, so that each drawing tool 8 moves in the closing direction (centripetal direction).

Therefore, while the spindle 10 and the cam shaft 12 rotate in the same direction, the speed of rotation of the cam shaft 12 becomes higher than the speed of rotation of the spindle 10, and a relative rotation difference (phase difference) arises between these shafts 10 and 12, and the drawing tools 8 are operated in the closing direction, thereby effecting the drawing of the metal tube 4.

When the opening/closing drive motor 43 is driven in a direction, opposite to the above-mentioned direction, to move the bracket 39 in the direction B in FIGS. 2 and 8A, the holder 33 is moved in the same direction B, so that the torque cam pins 34 are also moved in the same direction B. In accordance with this movement of the torque cam pins 34, the first roller 35 and second roller 36 of each torque cam pin, while guided by the slot 31 formed in the spindle 10, move along the axis of the spindle 10 in the direction B. At this time, the second roller 36 engages the side surface of the torque cam groove 32 to rotate the cam shaft 12 in a direction D in FIG. 8B relative to the spindle 10 since the torque cam groove 32, in which the second roller 36 is fitted, is formed into the spiral configuration as shown in FIGS. 8A and 8B. In accordance with this rotation of the cam shaft 12, the cam plate 29 also rotates in the direction D relative to the drawing tool-mounting member 22 fixedly mounted on the spindle 10. As a result, the shaft 25 of each drawing tool-supporting member 28 moves in a diameter-increasing direction (radial direction) relative to the volute-like groove 30.

Therefore, while the spindle 10 and the cam shaft 12 rotate in the same direction, the speed of rotation of the cam shaft 12 becomes lower than the speed of rotation of the spindle 10, and a relative rotation difference (phase difference) arises between these shafts 10 and 12, and the drawing tools 8 are moved in the opening direction (radial direction).

As described above, the amount of movement of each torque cam pin 34 in the normal direction and the amount of movement thereof in the reverse direction are defined respectively by the amount of normal rotation of the opening/closing drive motor 43 and the amount of reverse rotation thereof, and the relative rotation difference (phase difference) between the spindle 10 and the cam shaft 12 due to the movement of the torque cam pins 34 is defined by the profile of the torque cam grooves 32 shown in FIGS. 8A and 8B. Therefore, the profile of the torque cam grooves 32 is determined by the rotation of the opening/closing drive motor 43, the opening/closing torque and movement amount of the drawing tools 8 and so on.

The opening and closing movement of the drawing tools 8 by the normal and reverse operation of the opening/closing drive motor 43 is suitably associated with the axial movement of the metal tube (workpiece) 4 by the support mechanism 5, thereby drawing the distal end portion of the metal tube (workpiece) 4 into a desired shape such for example as a tapering shape or a smaller diameter.

The slots 31, as well as the torque cam grooves 32, are not limited to the shape shown in the above embodiment, and any suitable shape can be adopted in so far as the movement of the torque cam pins 34 can cause the spindle 10 and the cam shaft 12 to rotate relative to each other so as to produce the above relative rotation difference (phase difference). Therefore, the combination of the moving direction of the torque cam pins 34 and the rotating direction of the cam shaft 12 is not limited to that shown in the above embodiment.

Further, the slots 31 may be formed in the cam shaft 12 while the torque cam grooves 32 may be formed in the spindle 10.

Figure 14A:
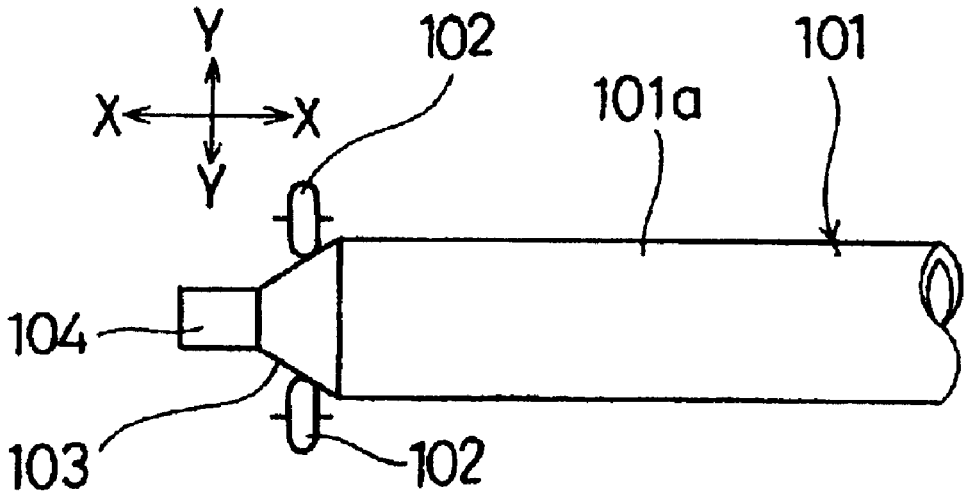
FIGS. 14A and 14B are views showing examples of drawing of a metal tube.
Figure 14B:
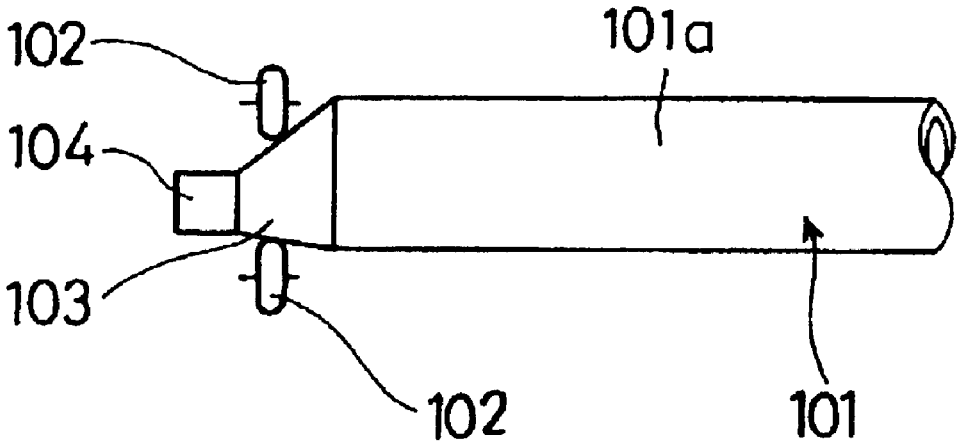

Further, the present invention can be applied not only to the drawing operation, shown in FIGS. 14A and 14B, but also to the eccentric drawing of the tube, disclosed in JP-B-2957153 and the inclined-type drawing of the tube disclosed in JP-B-2957154.

FIGS. 10 to 13 show a second embodiment in which there is shown another example of the mechanism for moving the drawing tools 8 in radial and centripetal directions by the relative rotation difference between the spindle 10 and the cam shaft 12 of the first embodiment, and in addition to the drawing tools 8, there are provided cutters (cutting-purpose circular blades) 73, and these cutter 73 are operated, utilizing the moving mechanism for the drawing tools 8.

Figure 10:
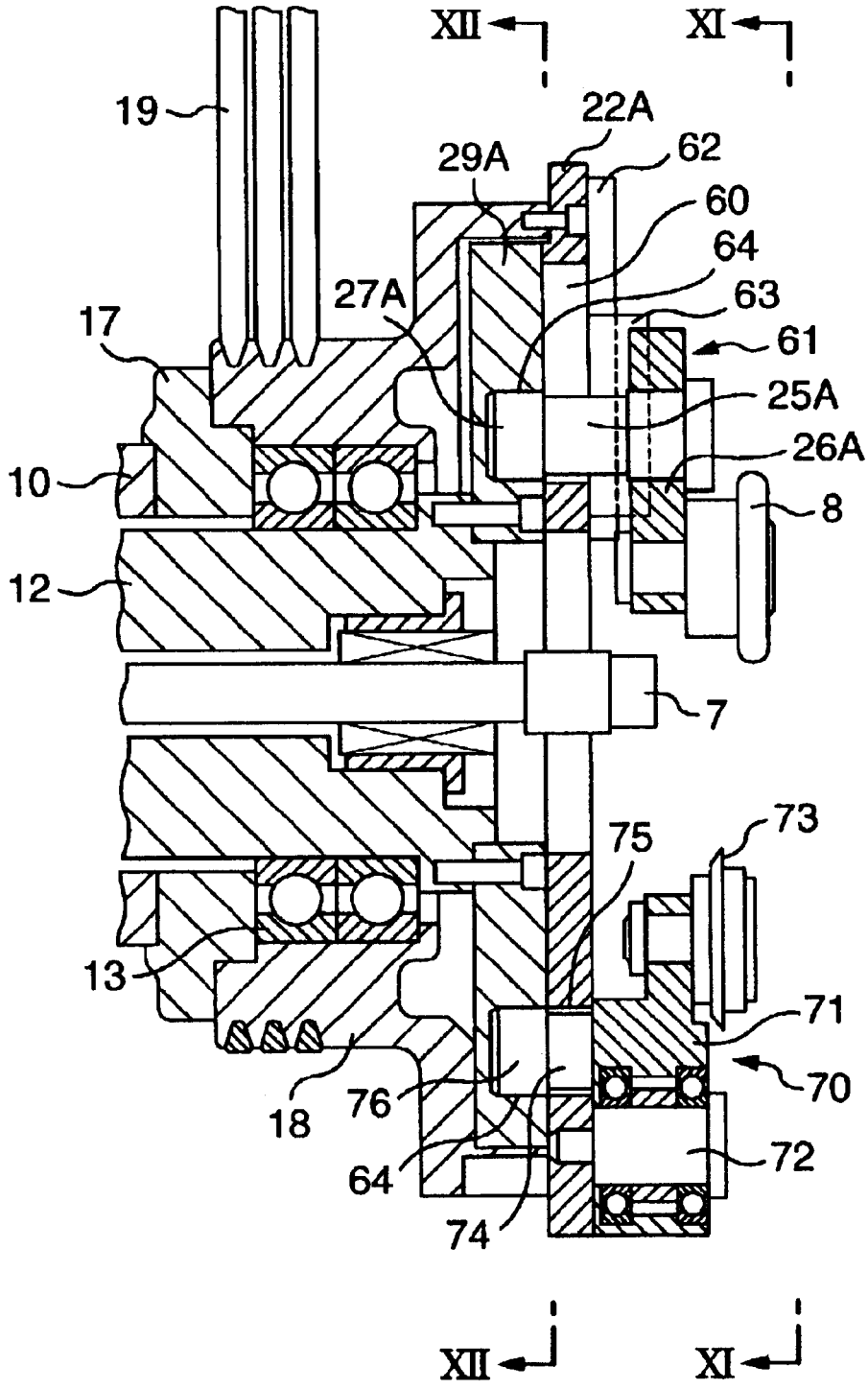
FIG. 10 is a side cross-sectional view of a portion of a second embodiment according to the present invention.

In this second embodiment, as shown in FIG. 10, reference numeral 7 denotes a mandrel, reference numeral 10 a spindle, reference numeral 12 a cam shaft, reference numeral 13 a bearing, reference numeral 7 a member, reference numeral 18 a mounting flange, and reference numeral 19 a belt, and these are the same as the corresponding members of the first embodiment.

Figure 11:
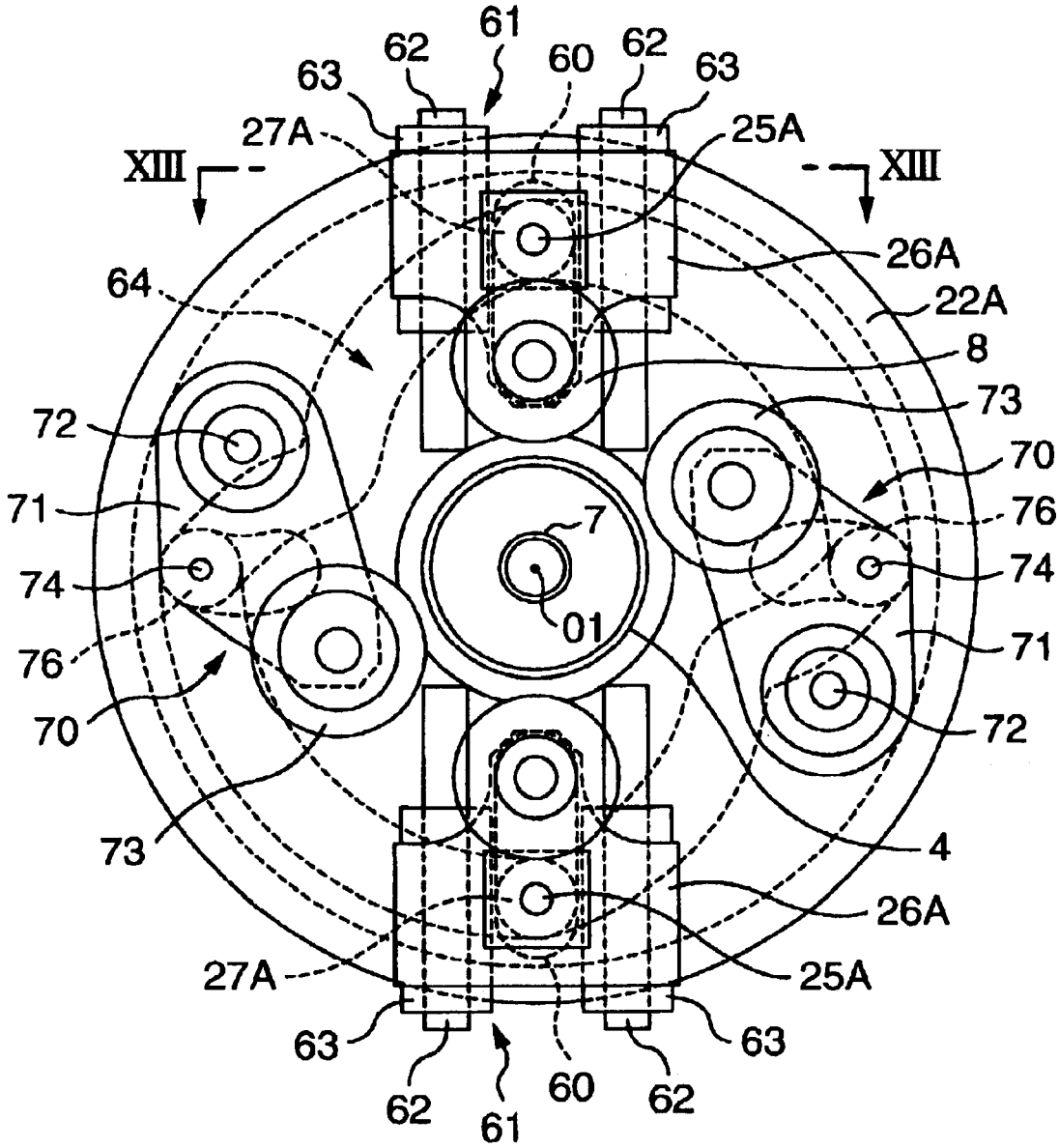
FIG. 11 is a front end view as seen from a side XI—XI of FIG. 10. However, drawing tools are held in an open condition.

A drawing tool-mounting member 22A is fixedly secured to a distal end of the mounting flange 18 which can rotate together with the spindle 10. Two insertion holes 60 are formed in the drawing tool-mounting member 22A, and extend radially of an axis O1 of the spindle 10 and cam shaft 12 as shown in FIG. 11. The insertion holes 60 are spaced 180 degrees from each other in the direction of the circumference of the drawing tool-mounting member 22A. Support shafts 25A are received respectively in the two insertion holes 60 so as to move in radial and centripetal directions, and tool support arms 26A are fixedly secured to front ends of the two support shafts 25A and 25A, respectively, and further drawing tools 8 similarly to the above are provided respectively at distal ends of the tool support arms 26A.

Figure 13:
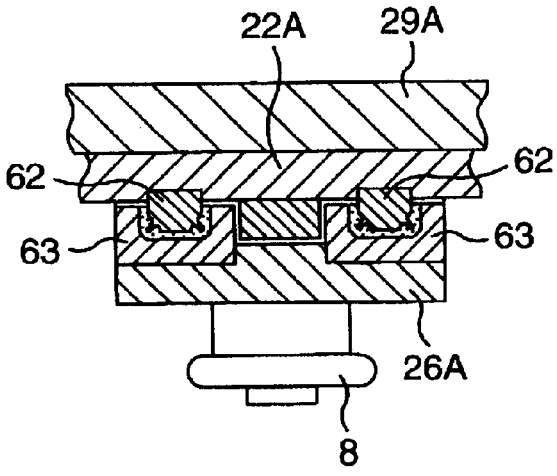
FIG. 13 is a cross-sectional view taken along the line XIII—XIII of FIG. 11.

The tool support arms 26A are guided in radial and centripetal directions relative to the axis O1 of the spindle 10 and cam shaft 12 by linearly-guiding devices 61, respectively. As shown in FIGS. 11 and 13, the linearly-guiding device 61 comprises parallel guide rails 62, which are fixedly secured to the front surface of the drawing tool-mounting member 22A and are disposed respectively on opposite sides of the insertion hole 60, and moving blocks 63 slidably fitted respectively on the guide rails 62.

A cam plate 29A is fixedly secured to a front end of the cam shaft 12, and this cam plate 29A can rotate together with the cam shaft 12. The cam plate 29A is disposed at a reverse side of the drawing tool-mounting member 22A, and can rotate relative to this member 22A.

Figure 12:
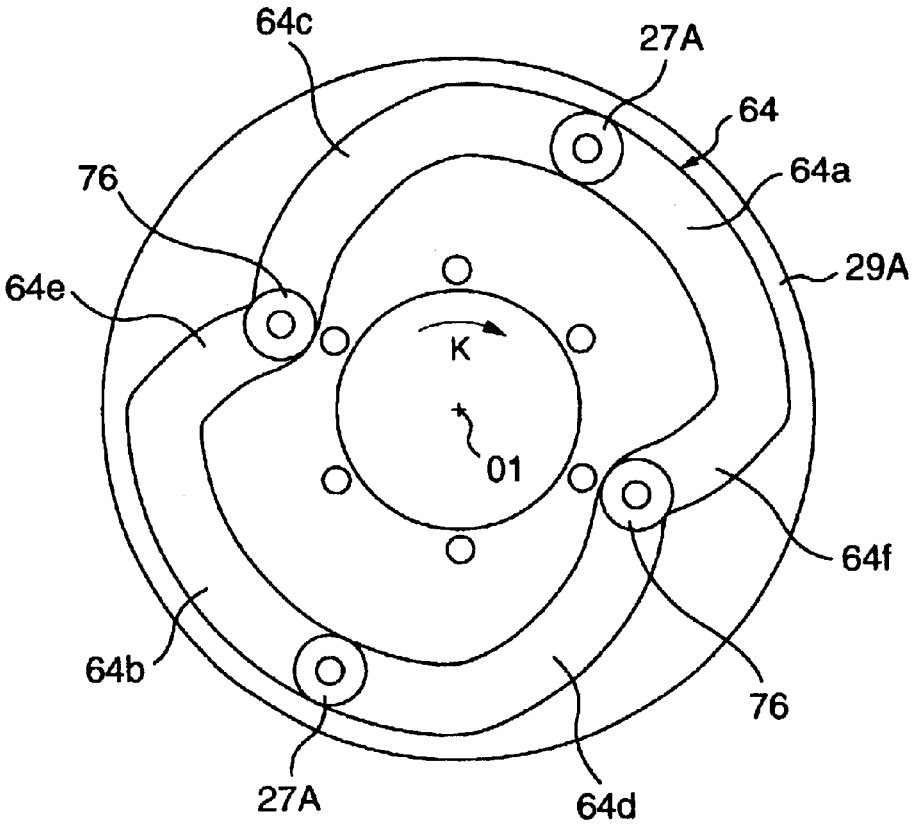
FIG. 12 is a front-elevational view of a cam plate as seen from the line XII—XII of FIG. 10.

As shown in FIG. 12, a cam groove 64 is formed in a front surface of the cam plate 29A, and the cam groove 64 includes two idling grooves 64A and 64*b* of an arcuate shape, lying on a circle having its center disposed at the axis O1 of the spindle 10 and cam shaft 12, two first processing grooves 64*c* and 64*d*, extending respectively from one ends of the idling grooves 64*a* and 64*b* in a diameter-decreasing manner, and second processing grooves 64*e* and 64*f* which extend respectively from the other ends of the first processing grooves 64*c* and 64*d* in a diameter-increasing manner and communicate respectively with the other ends of the idling grooves 64*a* and 64*b*, and these grooves are continuous with one another.

The two idling grooves 64*a* and 64*b* are provided symmetrically with respect to the axis O1, and each of these grooves extends over the area of about 90 degrees. The two first processing grooves 64*c* and 64*d* are provided symmetrically with respect to the axis O1, and the two second processing grooves 64*e* and 64*f* are provided symmetrically with respect to the axis O1.

Two rollers 27A and 27A, provided respectively at rear ends of the two support shafts 25A respectively supporting the two tool support arms 26A and 26A, are slidably fitted in the cam groove 64, and when the position of the drawing tool-mounting member 22A relative to the cam plate 29A is changed in the circumferential direction, the rollers 27A and 27A are guided by the cam groove 64 to be moved in the radial direction or the centripetal direction.

Next, a cutter device 70 will be described.

Cutter support arms 71 are provided on the front surface of the drawing tool-mounting member 22A, and are disposed between the pair of drawing tools 8 and 8 in the circumferential direction, and each of the cutter support arms 71 is rotatably mounted on the drawing tool-mounting member 22A by a support shaft 72. The circular cutters 73 are provided at distal ends of the cutter support arms 71, respectively. Further, a shaft 74 is formed on and projects from a rear surface of the cutter support arm 71, and is disposed between the support shaft 72 and the cutter 73, and the shaft 74 extends through a through hole 75, formed through the drawing tool-mounting member 22A, and a roller 76 is provided at a distal end of the shaft 74. The roller 76 is slidably fitted in the cam groove 64.

There are provided the two cutter devices 70, and the component parts of these cutter devices are disposed symmetrically with respect to the axis O1. Further, the rollers 76 and 76 are spaced about 90 degrees from the rollers 27A in the circumferential direction as shown in FIGS. 11 and 12.

When the position of the drawing tool-mounting member 22A relative to the cam plate 29A is changed in the circumferential direction, the rollers 76 and 76 are guided by the cam groove 64 to be moved in the radial direction or the centripetal direction, so that the cutters 73 and 73 are moved about the respective support shafts 72 and 72 in the radial direction or the centripetal direction.

The mechanism for rotating the spindle 10 and the cam shaft 12 in the same direction, speed-change means 50 for producing the relative rotation difference (phase difference) between the spindle 10 and the cam shaft 12, and so on are similar to those of the above first embodiment, and therefore explanation thereof will be omitted.

Next, the drawing and cutting of a metal tube in the second embodiment will be described.

As shown in FIG. 12, the rollers 27A and 27A of the pair of drawing tools 8 and 8 are disposed in the idling grooves 64*a* and 64*b* of the cam groove 64, respectively, and the rollers 76 and 76 of the pair of cutters 73 and 73 are disposed in the smallest-diameter portions of the cam groove 64, respectively, and in this condition the drawing tools 8 and 8 are in their open condition, and are spaced from the outer surface of the metal tube 4, and the cutters 73 and 73 are in a cutting-completed condition.

In this condition, when the drawing tool-mounting member 22A and the cam plate 29A are both rotated in a direction of an arrow K in FIG. 12, and the speed of rotation of the cam plate 29A is made higher than the speed of rotation of the drawing tool-mounting member 22A by the speed-change means 50, so that the cam plate 29A angularly moves in the direction of the arrow K in FIG. 12 relative to the drawing tool-mounting member 22, the rollers 27A and 27A of the pair of drawing tools 8 and 8 reach one ends of the idling grooves 64*a* and 64*b*, respectively, and then shift respectively into the first processing grooves 64*c* and 64*d* to move in the centripetal direction, so that the drawing of the metal tube 4 is effected by the drawing tools 8 and 8.

On the other hand, the rollers 76 and 76 of the pair of cutters 73 and 73 travel respectively along the second processing grooves 64*e* and 64*e* to move in the radial direction, and then shift respectively into the idling grooves 64*a* and 64*b*, so that the open condition is achieved.

Then, in this condition, when the speed of rotation of the cam plate 29A is made lower than the speed of rotation of the drawing tool-mounting member 22A by the speed-change means 50, so that the cam plate 29A is moved relative to the drawing tool-mounting member 22 in a direction opposite to the direction of the arrow K in FIG. 12, the rollers 27A and 27A of the drawing tools 8 and 8, which have finished the drawing operation, are moved in the radial direction by the first processing grooves 64*c* and 64*d*, respectively, so that the drawing tools 8 and 8 are opened, and then these rollers 27A and 27A shift respectively into the idling grooves 64*a* and 64*b*, thereby maintaining this open condition.

The rollers 76 and 76 of the pair of cutters 73 and 73 shift respectively from the idling grooves 64*a* and 64*b* into the second processing grooves 64*e* and 64*f* to be moved in the centripetal direction, so that the cutters 73 and 73 are moved in the centripetal direction to cut the metal tube 4.

The opening and closing of the drawing tools 8 and 8, as well as the opening and closing of the cutters 73 and 73, are effected when the cam plate 29A rotate in the normal and reverse directions relative to the drawing tool-mounting member 22A over the range of about 90 degrees.

The drawing operation is effected by moving the drawing tools 8 and 8 in the centripetal direction and by moving the metal tube 4 in the axial direction by a support mechanism 5. In the cutting operation, after finishing the drawing operation, the metal tube 4 is moved in the axial direction, and the cutters 73 and 73 are moved in the centripetal direction to cut a distal end portion of the drawn portion formed by spinning, thus cutting off or removing the distal end portion of an uneven wall thickness deformed by spinning.

CAPABILITY OF EXPLOITATION IN INDUSTRY

As described above, in the present invention, the spindle mechanism itself is used as an important portion of the speed-change mechanism for the spindle and the cam shaft, and therefore as compared with the conventional technique in which the speed-change mechanism and the interconnecting mechanism are provided separately from the spindle mechanism, the lightweight, low-cost and high-efficiency design of the overall apparatus can be achieved, and besides the high reliability is obtained because of the simplification of the mechanism.

Furthermore, as compared with the conventional construction, adverse effects due to a transmission loss, an inertia loss and a backlash are reduced, and therefore the processing of higher precision can be effected.

Furthermore, the torque cam grooves of a desired shape can be formed in the spindle or the cam shaft, and can be made long in the axial direction, and therefore the degree of freedom of setting of the profile of the torque cam grooves increases. Therefore, the relation between the relative rotation difference between the spindle and the cam shaft and the opening-closing degree and opening-closing speed of the drawing tools can be arbitrarily determined over a wide range, and the degree of freedom of processing by the drawing tools increases, and the possibility of the processing increases.

What is claimed is:

1. A spindle mechanism comprising:

a spindle having a distal end;

a drawing tool-mounting member for having drawing tools supported thereon for sliding movement in a radial direction, provided at said distal end of said spindle;

a cam shaft rotatably provided at said spindle in a coaxial relation thereto;

a cam plate that is provided at a distal end of said cam shaft and that rotates to cause said drawing tools to move in the radial direction, as a result of a relative rotation difference produced between said spindle and said cam shaft;

speed-change means for producing the relative rotation difference between said spindle and said cam shaft by adjusting a condition of engagement of said spindle with said cam shaft, both of said spindle and said cam shaft themselves constituting a part of said speed-change means.

2. A spindle mechanism according to claim 1, wherein a slot is formed in one of said spindle and said cam shaft in an axial direction while a spiral torque cam groove is formed in another and extends around an axis thereof, and a torque cam pin is engaged in said slot and said torque cam groove, and the position of said spindle relative to said cam shaft in a circumferential direction is changed by moving said torque cam pin in the axial direction by drive means.

3. A spindle mechanism according to claim 2, wherein said cam shaft is mounted within said spindle in a coaxial relation thereto, and said slot is formed in said spindle, and said torque cam groove is formed in said cam shaft.

4. A spindle mechanism according to claim 3, wherein a holder is mounted on an outer periphery of said spindle for rotation and for sliding movement in the axial direction, and said torque cam pin is provided at said holder, and said holder can be moved in the axial direction by drive means.

5. A spindle mechanism according to claim 1, wherein said spindle and said cam shaft are made of hollow tubes, respectively, and the latter is fitted into the former so as to rotate the latter relatively to the former, and a mandrel is provided in the hollow tube of a smaller diameter so as to move forward and backward.

6. A spindle mechanism according to claim 2, wherein said spindle and said cam shafts are made of hollow tubes, respectively, and the latter is fitted into the former so as to rotate the latter relatively to the former, and a mandrel is provided in the hollow tube of a smaller diameter so as to move forward and backward.

7. A spindle mechanism according to claim 3, wherein said spindle and said cam shafts are made of hollow tubes, respectively, and the latter is fitted into the former so as to rotate the latter relatively to the former, and a mandrel is provided in the hollow tube of a smaller diameter so as to move forward and backward.

8. A spindle mechanism according to claim 4, wherein said spindle and said cam shafts are made of hollow tubes, respectively, and the latter is fitted into the former so as to rotate the latter relatively to the former, and a mandrel is provided in the hollow tube of a smaller diameter so as to move forward and backward.

* * * * *